US006430820B1

(12) United States Patent
Chessari et al.

(10) Patent No.: US 6,430,820 B1
(45) Date of Patent: Aug. 13, 2002

(54) MARKING MACHINE

(75) Inventors: Patrick Chessari, Grand Croix; Marcel Therond, Rillieux la Pape, both of (FR)

(73) Assignee: Technifor, Miribel (FR)

( * ) Notice: Subject to any disclaimer, the term of this patent is extended or adjusted under 35 U.S.C. 154(b) by 0 days.

(21) Appl. No.: 09/499,750

(22) Filed: Feb. 8, 2000

(30) Foreign Application Priority Data

Feb. 9, 1999 (FR) ..... 99 01665

(51) Int. Cl.[7] ..... B43L 11/00
(52) U.S. Cl. ..... 33/26; 33/18.1; 33/27.01
(58) Field of Search ..... 33/26, 18.1, 27.01, 33/27.02, 27.03, 27.031, 27.033, 32.1, 32.3, 503

(56) References Cited

U.S. PATENT DOCUMENTS

| | | | | | |
|---|---|---|---|---|---|
| 1,113,404 | A | * | 10/1914 | Blair | 33/26 |
| 2,219,783 | A | * | 10/1940 | Matson | 33/26 |
| 2,701,417 | A | * | 2/1955 | Graham | 33/18.1 |
| 2,950,535 | A | | 8/1960 | Burgess | |
| 3,211,061 | A | | 10/1965 | Cretsinger | |
| 4,709,483 | A | * | 12/1987 | Hembree et al. | 33/18.1 |
| 5,009,013 | A | * | 4/1991 | Wiklund | 33/23.03 |
| 5,042,155 | A | * | 8/1991 | Yoshioka et al. | 33/18.1 |
| 5,079,849 | A | * | 1/1992 | Nirenberg | 33/575 |
| 5,276,970 | A | * | 1/1994 | Wilcox et al. | 33/1 M |
| 5,507,212 | A | * | 4/1996 | Morrison | 30/164.9 |
| 5,594,991 | A | * | 1/1997 | Therond | 33/18.1 |
| 5,667,353 | A | | 9/1997 | Drake | |
| 6,295,737 | B2 | * | 10/2001 | Patton et al. | 33/26 |

FOREIGN PATENT DOCUMENTS

| | | |
|---|---|---|
| EP | 0586328 | 3/1994 |
| FR | 2677925 | 12/1992 |

* cited by examiner

*Primary Examiner*—Diego Gutierrez
*Assistant Examiner*—Yaritza Guadalupe
(74) *Attorney, Agent, or Firm*—Dowell & Dowell, P.C.

(57) ABSTRACT

A marking machine including a frame, an arm articulated on the frame about an axis of articulation, and a marking tool movably mounted on the arm, The marking tool is movable in translation with respect to the arm.

11 Claims, 4 Drawing Sheets

MARKING MACHINE

BACKGROUND OF THE INVENTION

1. Field of the Invention

The present invention relates to a marking machine, and more particularly to a marking machine comprising a frame on which a marking assembly is articulated. It is applicable to producing a pattern on the surface of a piece, whether by printing on this surface, deformation thereof, or removal of matter therefrom.

2. Brief Description of the Related Art

EP-A-0 586 328 discloses a marking machine comprising a frame and a first arm, free to pivot with respect to this frame. A second arm, whose end opposite the first arm receives a marking tool, is articulated on the end of this first arm opposite the frame.

However, this machine, of which the marking assembly is formed by two mutually articulated arms, presents certain drawbacks. For example, the first arm is heavy, insofar as it bears drive elements for displacing the second arm. In addition, as these drive elements are placed near the end of this first arm opposite the frame, this induces a high moment of the marking assembly on the frame, which is detrimental to the correct functioning of the machine.

In addition, the programming of such a marking machine proves to be complex, since it is necessary to take into account the angular divergences existing, on the one hand, between the frame and the first arm, and, on the other hand, between the first and second arms. Moreover, a determined point may be attained via two different positions of the first and second arms.

It is an object of the present invention to overcome the drawbacks set forth hereinabove.

SUMMARY OF THE INVENTION

To that end, it relates to a marking machine comprising a frame, an arm articulated on said frame about an axis of articulation, and a marking tool mounted mobile on said arm, characterized in that a single arm is provided and in that said machine further comprises means for displacing said marking tool in translation with respect to said single arm.

Other characteristics of the invention from the subject matter of the claims.

BRIEF DESCRIPTION OF THE DRAWINGS

The invention will be more readily understood on reading the following description given by way of non-limiting example with reference to the accompanying drawings, in which.

DESCRIPTION OF PREFERRED EMBODIMENT

Figure 1:
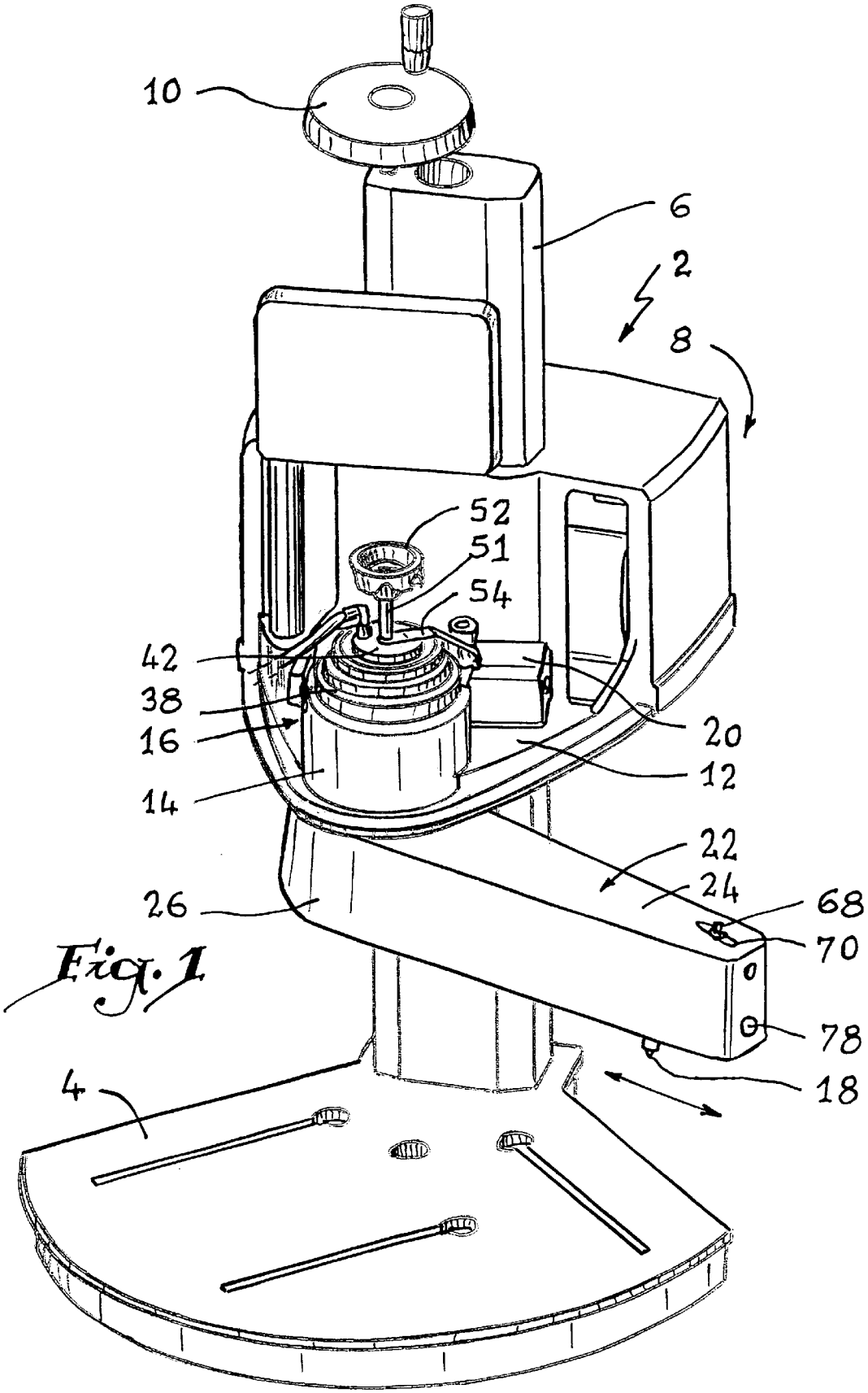
FIG. 1 is a view in perspective of a marking machine according to the invention.

Referring now to the drawings and firstly to FIG. 1, the marking machine according to the invention, generally designated by reference 2, comprises a base 4 for receiving a piece to be marked (not shown), from which a vertical support 6 extends. This support 6 receives a bracket or frame 8, and a wheel 10 conventionally allows the height of this bracket 8 to be adjusted with respect to the support 6.

The bracket 8 presents a lower area 12 projecting with respect to the front of the support 6. A substantially cylindrical, vertical box 14, of axis A, projects from the periphery of the area 12. As will be described in greater detail hereinbelow, this box 14 provides pivotal housing about axis A for a mobile marking assembly, designated by reference 16 and equipped with a marking tool 18. The area 12 supports a housing 20 interposed between the support 6 and the box 14, which receives a motor (not shown), intended to ensure pivoting of the marking assembly 16 with respect to the box 14.

Figure 2:
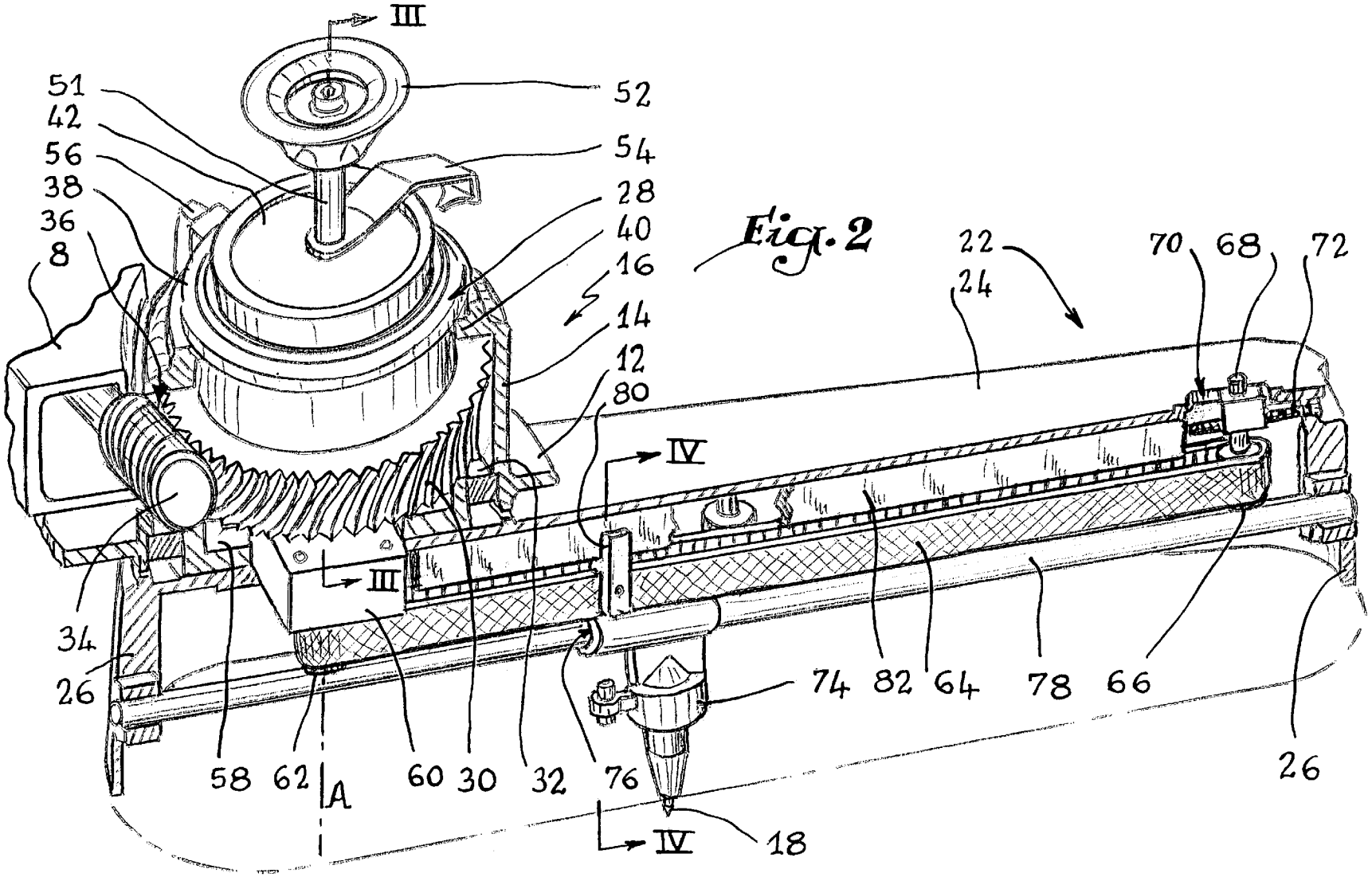
FIG. 2 is a longitudinal section in perspective of a mobile marking assembly belonging to the machine shown in FIG. 1, FIGS. 3 and 4 are sections on a larger scale along lines III—III and IV—IV of FIG. 2.
Figure 3:
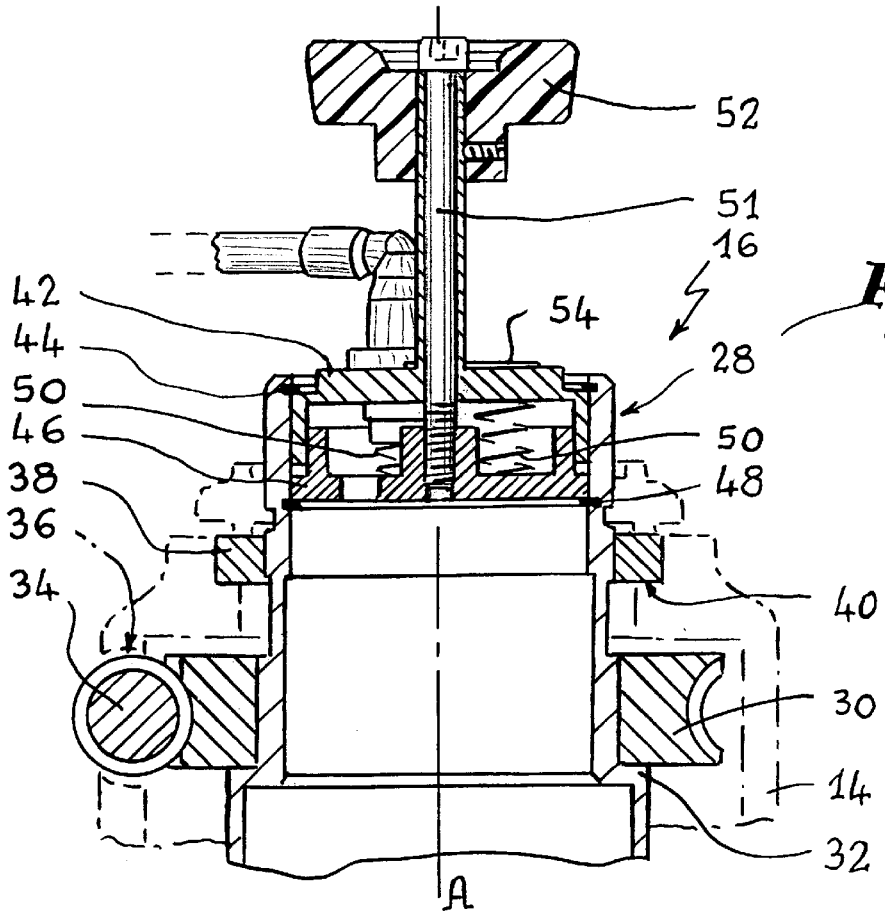
Figure 4:
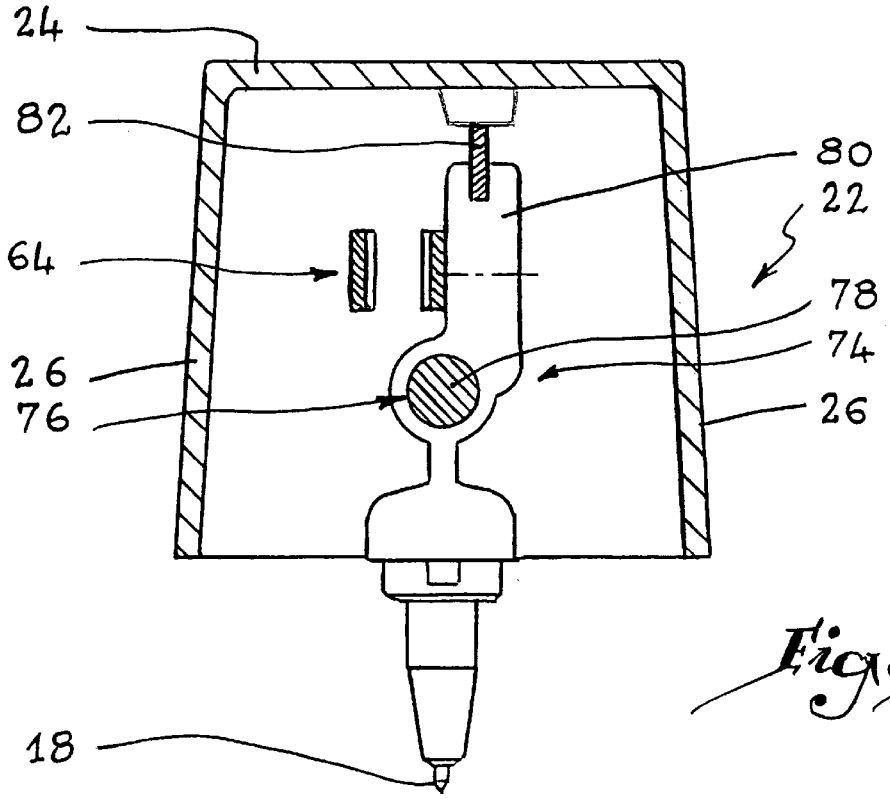

As shown in FIGS. 2 to 4, the marking assembly 16 comprises a single elongated arm 22. This arm, which is open in the direction of the base 4, is provided with an upper web 24 extended by a peripheral lateral wall 26.

The marking assembly 16 also comprises a substantially cylindrical, hollow chamber 28 mounted to pivot in the box 14 and fast with the arm 22. To that end, a worm wheel 30 is arranged on a shoulder 32 with which the outer wall of the chamber 28 is provided. This worm wheel 30 cooperates with an endless screw 34, received in the housing 20 and actuated by a motor (not shown). This endless screw comes into contact with the worm wheel 30 through a cut 36 made in the box 14. The marking assembly 16 is therefore free to pivot about the principal axis A of the chamber 28.

The chamber 28 is maintained axially with respect to the box 14 via an upper flange 38 provided around the chamber 28, cooperating with an inner shoulder 40 of the box 14. Ball bearings or the like (not shown), are interposed between this flange 38 and this shoulder 40, in order to ensure easy pivoting of the box with respect to the chamber.

The chamber 28 is obturated in its upper part by a cover 42 disposed below a securing ring 44. A disc 46 is placed beneath the cover 42 and abuts, by its lower face, against a lower ring 48. Springs 50, interposed between the disc 46 and the cover 42, tend to push the latter against the upper ring 44. In this first position, the cover 42 is prevented from rotating, by friction on the ring 44, relative to the marking assembly.

The cover 42 is secured to a rod 51 extending along axis (A) and terminating in a handle 52. The end of this rod opposite the handle has a threading cooperating with a central tapping made in the disc 46. The cover is also secured to a tab or marker element 54 extending radially beyond the periphery of the chamber 28. This marker element is adapted to come plumb with a detector 56, for example incorporating a photo-electric cell, fixed to the box 14.

It should be noted that there is a certain axial clearance between the opposite walls of the cover 42 and of the disc 46, with the result that they may be disconnected from the respective rings 44 and 48, by screwing the rod 51 downwardly against the springs 50. In this second position, the cover 42, as well as the marker element 54, are free to pivot with respect to the chamber 28.

The chamber 28 is provided with a bottom 58 receiving a motor 60 whose downwardly projecting driven shaft is connected to a pinion 62 for actuating a synchronous belt 64, forming a loop. This belt, which extends axially over a major part of the length of the arm 22, passes, at its end opposite the pinion 62, around a roller 66. The latter penetrates, by an axial finger 68, in a cut 70 made in the upper web 24 of the arm 22. This finger 68 is fixed in this cut by a screw 72 passing through the peripheral wall 26.

The belt 64 drives a carriage 74 bearing the marking tool 18. The belt and the carriage are for example joined by adhesion. This carriage has a bore 76 made therein, which is traversed by a longitudinal guiding bar 78 extending between the two ends of the peripheral web 24. This bore 76 is disposed in the direction of the tool 18 with respect to the belt 64. The carriage is in addition provided with an end stirrup element 80, opposite the tool, which overlaps a blade 82 intended to avoid pivoting of the carriage and fixed on the upper wall of the web 24. The marking tool 18 is supplied, in known manner, by pneumatic or electric means (not shown).

The marking tool 18 may therefore be displaced, with respect to a piece to be marked, both under the effect of the pivoting of the arm 22 with respect to the bracket 8 and under the effect of the translation of the carriage 74 with respect to this arm 22.

The position of the marking tool may be determined by using so-called polar coordinates, namely on the one hand, the radial distance separating it from its point of origin in translation, which corresponds to its abutment against an origin (not shown) fast with the arm and, on the other hand, the angle of the arm with respect to the position of origin in rotation, in which the marker element 54 is plumb with the detector 56.

Figure 5:
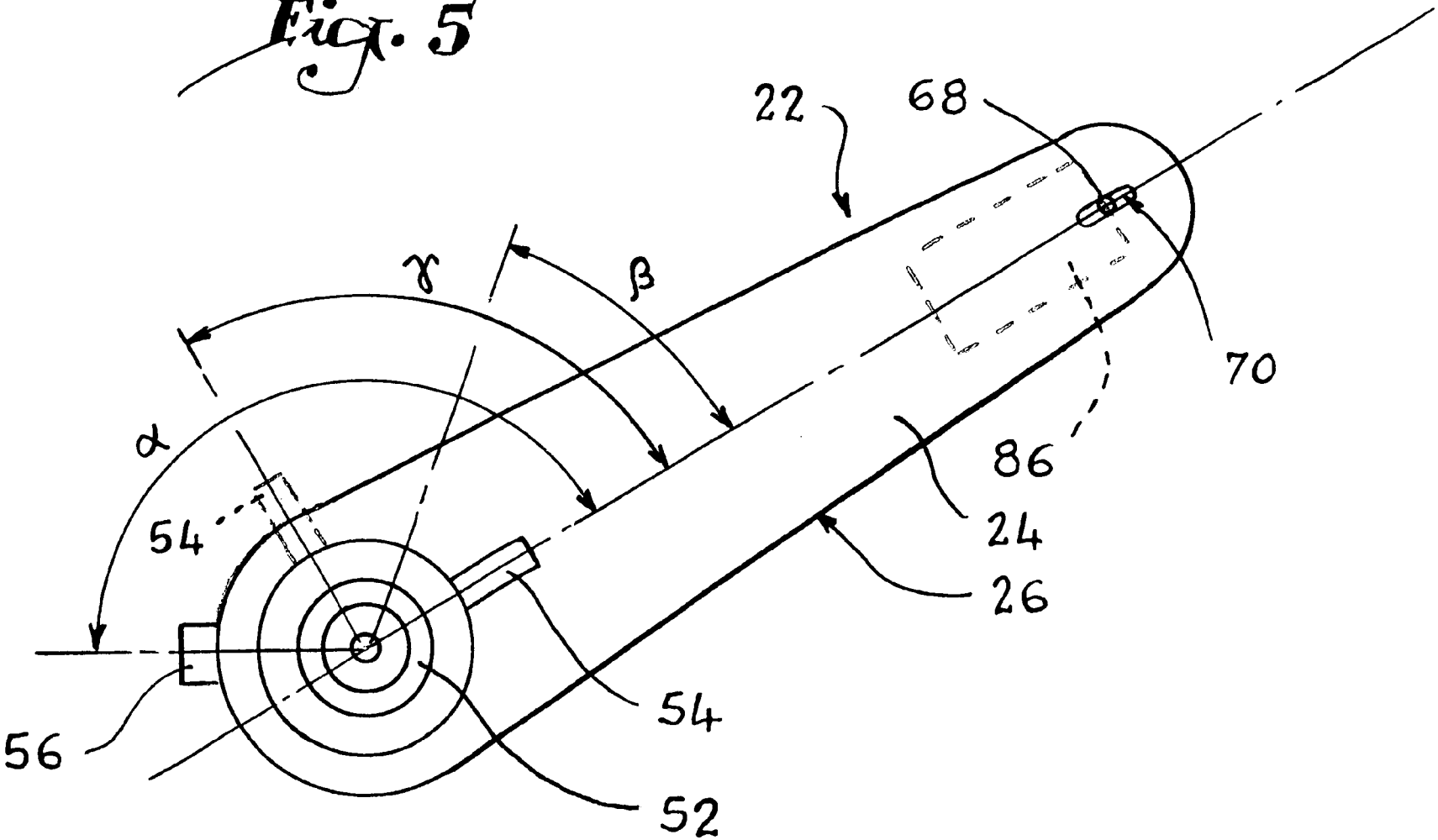
FIG. 5 is a schematic plan view illustrating, in two different positions, a tab forming marker element with which the mobile marking assembly of FIGS. 2 to 4 is equipped.

Once the marking has been effected, the marking assembly 16 should be pivoted about axis A of the box 14, so as to clear the region occupied by the marked piece 86, shown in broken lines in FIG. 5, and to return the marking assembly 16 into its position of origin. In the position shown in FIG. 5, it is therefore theoretically necessary to pivot the marking assembly 16 through an angle $\alpha$ corresponding to the angular divergence between the marker element 54 and the detector 56. However, this angle $\alpha$ is clearly greater than the angle $\beta$ representing the pivoting sufficient to disengage the arm from the region of the marked piece 86.

In order to reduce the duration of pivoting of the arm, it is possible to pivot the marker element 54 with respect to the arm 22 through an angle $\gamma$ corresponding to the difference between the theoretical angle $\alpha$ and the angle $\beta$ sufficient to disengage the arm from the marked piece. Such pivoting of the marker element 54 is represented in broken lines. To that end, the rod 51 is screwed downwardly so as to axially move the cover 42 and the disc 46 apart with respect to the rings 44 and 48. The cover 42 and the disc 46 are then disconnected in rotation with respect to the chamber 28, and the marker element 54 is rotated through angle $\gamma$.

With a view to driving the marking tool, it may be provided to replace the synchronous belt by a screw extending along the principal axis of the arm and cooperating with a nut secured to the carriage.

The invention enables the objectives set forth hereinabove to be achieved. The use of a single pivoting arm, with respect to which the marking tool is mobile in translation, guarantees an easier programming compared to the prior art. In effect, the position of a point may be determined in polar coordinates, which is notably easier than by taking into account two different angles, as in the prior art. Moreover, a determined point presents one sole couple of polar coordinates, which may be achieved by means of a single position of the arm and of the carriage, contrary to the prior art.

As the marking tool is mobile in translation, it presents a low inertia, which guarantees it a satisfactory mobility. The marking produced by the machine of the invention may therefore be effected more rapidly than in the prior art.

As the marking tool is mobile in translation with respect to the single arm, the weight of the latter is notably less than in the prior art, insofar as it does not bear any drive element at its end opposite the frame, contrary to what exists in the prior art.

It is also advantageous to arrange, near the pivot axis of the arm, drive means for displacing the marking tool. In effect, this characteristic reduces the moment of the arm on the frame of the machine, very substantially with respect to the prior art.

It is advantageous to use of a marker element capable of being disconnected in rotation with respect to the mobile marking assembly. In effect, it makes it possible to limit the movement of pivoting of this mobile assembly when it returns into the position of origin. A substantial amount of time is therefore saved by such an arrangement.

What is claimed is:

1. A marking machine including a support, a frame member extending generally horizontally outwardly in transverse relationship from said support, an arm having an inner end pivotally mounted relative to said frame member about a pivot axis which is substantially perpendicular relative to said frame member and an outer end, said arm having an outer free end which is cantilevered outwardly relative to said support so as to be moveable in an arc substantially parallel relative to said frame member, a marking tool, means for mounting said marking tool to said arm so as to be moveable along a portion of a length of said arm between said inner and outer ends thereof so as to adjust a spacing of said marking tool relative to said pivot axis, and means for controlling movement of said marking tool relative to said arm.

2. The marking machine of claim 1 including a base having an upper surface adapted to support an object to be marked, said support extending perpendicular relative to said base, and said marking tool being adjustable throughout an area of a plane extending substantially parallel to said upper surface of said base.

3. The marking tool of claim 1 in which said means for controlling movement of said marking tool includes a motor, and drive means connected between an output of said motor and said marking tool.

4. The marking machine of claim 3 in which said drive means includes a continuous belt which extends along said portion of a length of said arm and having a first end connected to means drivingly connected to said motor and a second end mounted adjacent said free end of said arm.

5. The marking machine of claim 4 in which said marking tool is carried by a carriage member said carriage member being movable in response to movement of said continuous belt, and means for guiding said carriage member along said portion of a length of said arm.

6. The marking machine of claim 4 in which said means for guiding said carriage member includes a bar mounted to said arm, said carriage member including a first portion cooperatively engaging said bar such that said carriage member is slidable along said bar, and said carriage member including a second portion drivingly connected to said continuous belt such that said carriage member is moveable with said continuous belt.

7. The marking machine of claim 6 in which said carriage member includes a stirrup element, and said arm including guide means extending generally parallel to said bar for guiding said stirrup element to thereby prevent rotation of said carriage member relative to said bar.

8. The marking machine of claim 1 in which said marking tool is carried by a carriage member which is movable connected to said drive means, and means for guiding said carriage member along said portion of a length of said arm.

9. The marking machine of claim 8 in which said means for guiding said carriage member includes a bar mounted to said arm, said carriage member having a first portion guidingly supported on said bar and a second portion engageable with a member carried by said arm for thereby preventing pivoting of said carriage member relative to said bar.

10. The marking machine of claim 1 including a detector means mounted relative to said frame member, a marker element being mounted so as to be selectively pivotable about said pivot axis, and means for connecting said marker element relative to said arm so as to pivot about said pivot axis simultaneously with a pivotal movement of said arm about said pivot axis and to selectively release said marker element so as to be pivotal about said pivot axis independently of said arm, whereby said marking element may be used to determine angular relationships of said arm relative to said pivot axis.

11. The marking machine of claim 10 wherein said means for selectively connecting said marker element to move simultaneously with said arm includes a rod extending along said pivot axis and having an outer handle, said marker element being fixedly mounted to said rod, and means for connecting said rod to move with said arm when said rod is in a first position and means for releasing said rod to freely rotate by operation of said handle when said means for connecting is in a second position.

* * * * *